US008073378B2

(12) United States Patent
Calamita et al.

(10) Patent No.: US 8,073,378 B2
(45) Date of Patent: Dec. 6, 2011

(54) XEROGRAPHIC STATION DESKEW MECHANISM

(75) Inventors: James P. Calamita, Spencerport, NY (US); Mark A. Atwood, Rush, NY (US)

(73) Assignee: Xerox Corporation, Norwalk, CT (US)

( * ) Notice: Subject to any disclaimer, the term of this patent is extended or adjusted under 35 U.S.C. 154(b) by 819 days.

(21) Appl. No.: 12/115,032

(22) Filed: May 5, 2008

(65) Prior Publication Data

US 2009/0274503 A1 Nov. 5, 2009

(51) Int. Cl.
*G03G 15/00* (2006.01)

(52) U.S. Cl. ..... 399/394; 399/395; 399/301; 400/692; 347/116

(58) Field of Classification Search ..... 399/18, 399/21, 366, 364, 301; 400/691, 693, 692
See application file for complete search history.

(56) References Cited

U.S. PATENT DOCUMENTS

| | | | | |
|---|---|---|---|---|
| 4,816,844 | A * | 3/1989 | Uchida et al. | 347/116 |
| 6,418,286 | B1 | 7/2002 | Hou | |
| 6,903,758 | B1 * | 6/2005 | Kerxhalli et al. | 347/116 |
| 7,403,720 | B2 * | 7/2008 | Nomura et al. | 399/12 |

OTHER PUBLICATIONS

See application p. 3 for related unpublished U.S. Appl. No. 12/053,704 & U.S. Appl. No. 12/053,753.

* cited by examiner

*Primary Examiner* — Matthew G Marini
(74) *Attorney, Agent, or Firm* — Ronald E. Prass, Jr.; Prass LLP

(57) ABSTRACT

In a color marking assembly, a series or plurality of ROS-imaging station units are aligned above an endless image transfer belt. Since there are a plurality of units, image alignment between the several station units is important. To accomplish this, skewing of each of the stations is necessary. The present invention involves a fixed ROS unit and a movable or skewable imaging station. This imaging station is movable on at least three spheres, one sphere below the imaging station and on its inboard side, the other spheres are located on a track below the imaging station and on its outboard side. This arrangement reduces vibration of these stations while at the same time providing an easily skewable xerographic imaging station.

1 Claim, 5 Drawing Sheets

XEROGRAPHIC STATION DESKEW MECHANISM

This invention relates to an electrophotographic color system and more specifically to a deskewing structure and process used in these systems to improve color image registration.

BACKGROUND

There is known a color system where an array or series of different color imaging stations are aligned above an endless belt. Each station contains an upper positioned raster output scanner (ROS), and below the ROS an imaging station comprising a photoreceptor drum, development station, and cleaning station. The ROS emits an electronic beam (laser) which impinges on the rotating photoconductive drum, thereby causing that location on the drum to undergo a change in electrical charge. As the drum continues to rotate past the development station, toner particles of a color which is unique to that imaging station will attach to the drum at the location charged by the ROS. This colored image is then transferred to an intermediate transfer belt that is passing by, and in contact with, the photoreceptor drum. As the intermediate belt passes by the different imaging stations (each usually containing a different color) it picks up subsequent color layers to create a complete color image which is then transferred to media.

Each colored beam must be in substantial registration with the other beams deposited on the belt for a final color copy. This registration is monitored by a sensor(s) to ensure proper alignment. If any color needs to be re-aligned or skewed, the ROS or imaging station is moved accordingly. In one embodiment there are also two sensors (Mark On Belt, or MOB sensors) that are fixed in position to a point on the machine frame, such that the colored images pass within view of these sensors. These sensors serve to detect the misregistration or misalignment between colors. The actuation of the deskew portion of the correction is performed via either a ROS mechanism or with an imaging station deskew mechanism, as in this invention. Each ROS unit and imaging station has its own motor so that they could independently be skewed for image alignment. This type of color system having an array of ROS units is generally described in U.S. Pat. No. 6,418,286 and is incorporated by reference into this disclosure.

Also, in U.S. application Ser. Nos. 12/053,704 and 12/053,753 structures and systems for deskewing the movable ROS unit are disclosed. The present invention involves a stationary ROS unit and a movable imaging station below said ROS (Raster Output Scanner). The disclosures of Ser. Nos. 12/053,704 and 12/053,753 are incorporated herein by reference.

As noted above, the color image deposited on the drum is subsequently deposited onto the belt. As the drum continues to rotate, it passes through the development station with a latent image which causes toner to stick to the drum where the electrical discharging (by the ROS) has taken place. The drum further rotates until the image is in contact with this intermediate transfer belt where the image is transferred from the drum to the belt. Each of the six or plurality of imaging stations deposits its own color and subsequently movement of the belt is moved past each of the imaging stations and allows each of the color separations to be deposited in turn. Thus, when the colors are out of alignment as indicated by sensors, the image needs to be skewed as does the image beam. By placing registration images side by side on the intermediate belt, the MOB sensors will indicate (to a controller or to a motor adjacent each unit), how much each imaging station needs to be skewed to provide the optimum color-to-color registration deposited on the belt by the six or several ROS-imaging station units.

When these units in the prior art are not robust to vibration sources within the imaging system, they cause "banding". These prior art units are susceptible to vertical vibration which generally causes imprecise image deposition. By "banding" is meant a series of dark and light image lines causing image quality defects or color variations. The present invention involves an improved ROS fixed mounting and a movable imaging station skew adjustment mechanism.

SUMMARY

The present configuration comprises rigidly mounting the ROS to the machine frame and employing a pivot mechanism for the xerographic imaging stations. The xerographic imaging station pivots about a spherical mounting on the inboard side of the subsystem and can be actuated by a slide or track mechanism on the outboard side. The inboard mounting sphere sits in a cone socket to locate the inboard side of the xerographic station and the outboard spheres mount in a slide mechanism that is actuated left and right to change the relative skew of the drum with respect to the ROS and its emitted beam. This 3-point mount allows the orientation of the xerographic station relative to the rest of the machine to be maintained. A linear motor receives beam misalignment information from sensors in the system, and this motor moves the imaging station automatically precisely into proper image registration.

DETAILED DISCUSSION OF DRAWINGS AND PREFERRED EMBODIMENTS

Figure 1:
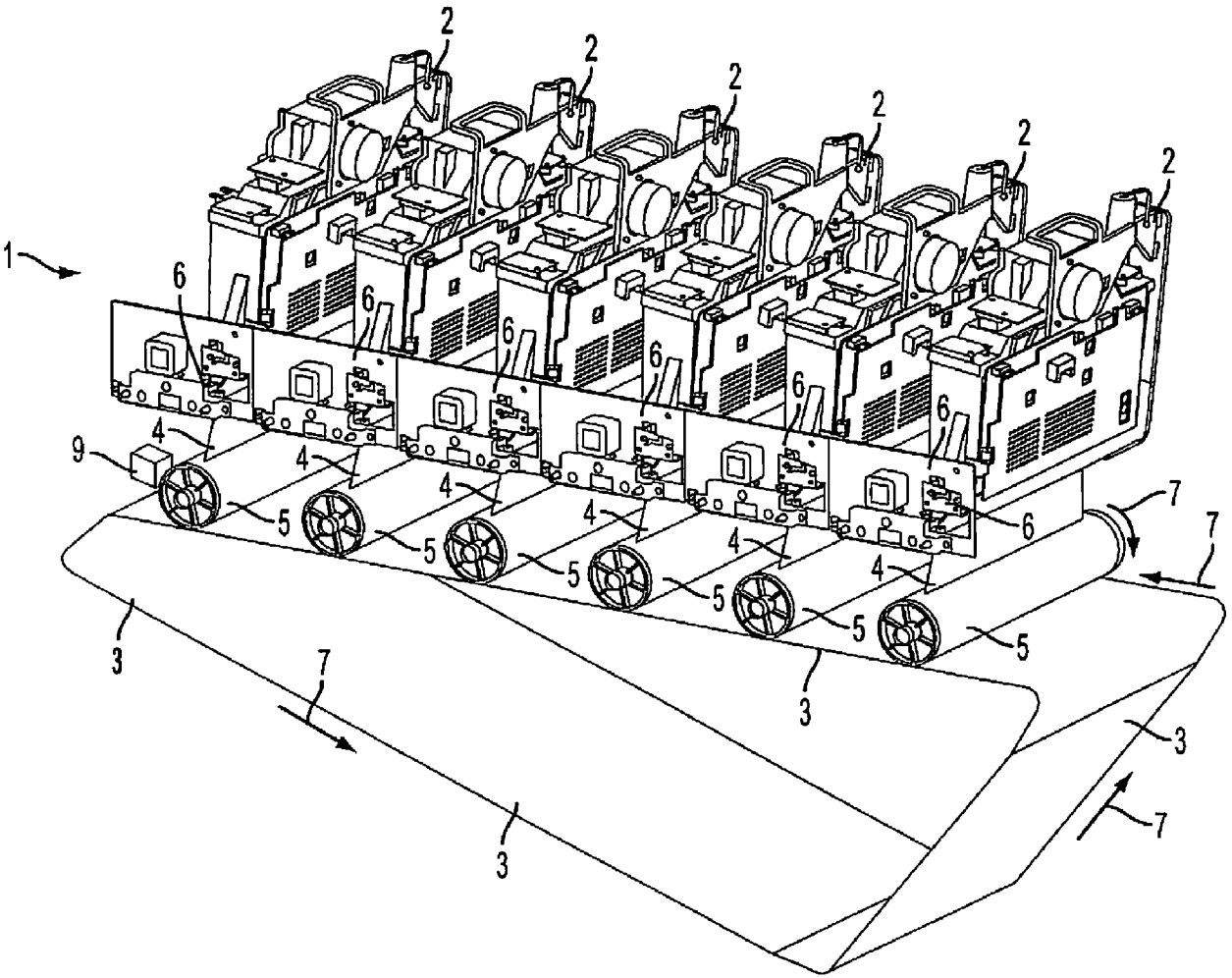
FIG. 1 is an isometric view of a 6 station intermediate belt transfer xerographic system where the plural ROS imaging station units are aligned along a transfer belt.
Figure 4:
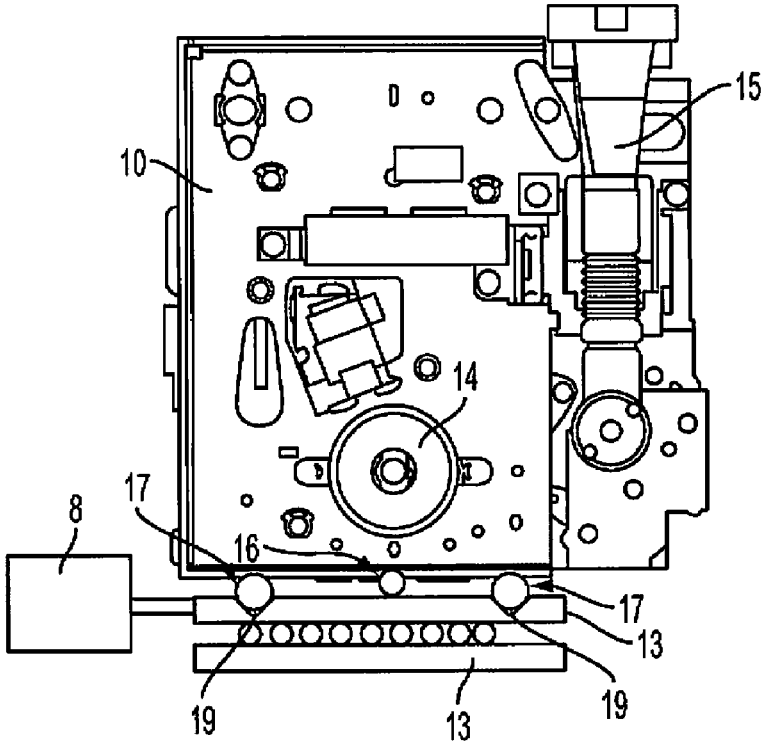
FIG. 4 is a plan front view of the imaging station with the imaging station deskewing structure of this invention.

In FIG. 1, a color imaging system 1 where the deskewing mechanism of the present invention may be used is illustrated having an array (two or greater) of raster output scanners (ROS) 2 and their associated photoreceptor drums 5 (which are part of the imaging stations shown in FIG. 2) aligned above an endless intermediate transfer belt 3. Each ROS emits a different image beam 4 on a photoconductive drum 5 to charge the drum's surface where the image for that color will be located. As the drum 5 rotates, the charged regions pick up toner of the color for that particular imaging station and transfer this color image to the surface of the belt 3 so that each colored image is deposited in relation to the previous deposited image. At the end of the process, all six deposited images (that are color developed at each station) are precisely aligned to form the final color image which is eventually transferred to media. The arrows 7 indicate the rotation direction of drum 5 and belt 3. At the location of actuator 8 (as shown in FIG. 4) the linear actuator 8 used in the present invention is generally shown. Any number of sensors 9 may be used to monitor the alignment or misalignment of beams 4 and relay this information to motor 22 and actuator 8.

A typical xerographic imaging system useful in the present invention and employing ROS units, as above described, is disclosed in U.S. Pat. No. 6,418,286B1. This patent disclosure is incorporated by reference into the present disclosure.

It is in the above type xerographic imaging systems such as that shown in FIG. 1 that the rigidly fixed ROS and the movable imaging stations 10 with a linear actuator 8 permit easy deskewing the imaging stations 10 and also eliminate the vibration problems of the prior art. Any number of ROS 2-Imaging station 10 units greater than two may be used in the present invention.

Figure 2:
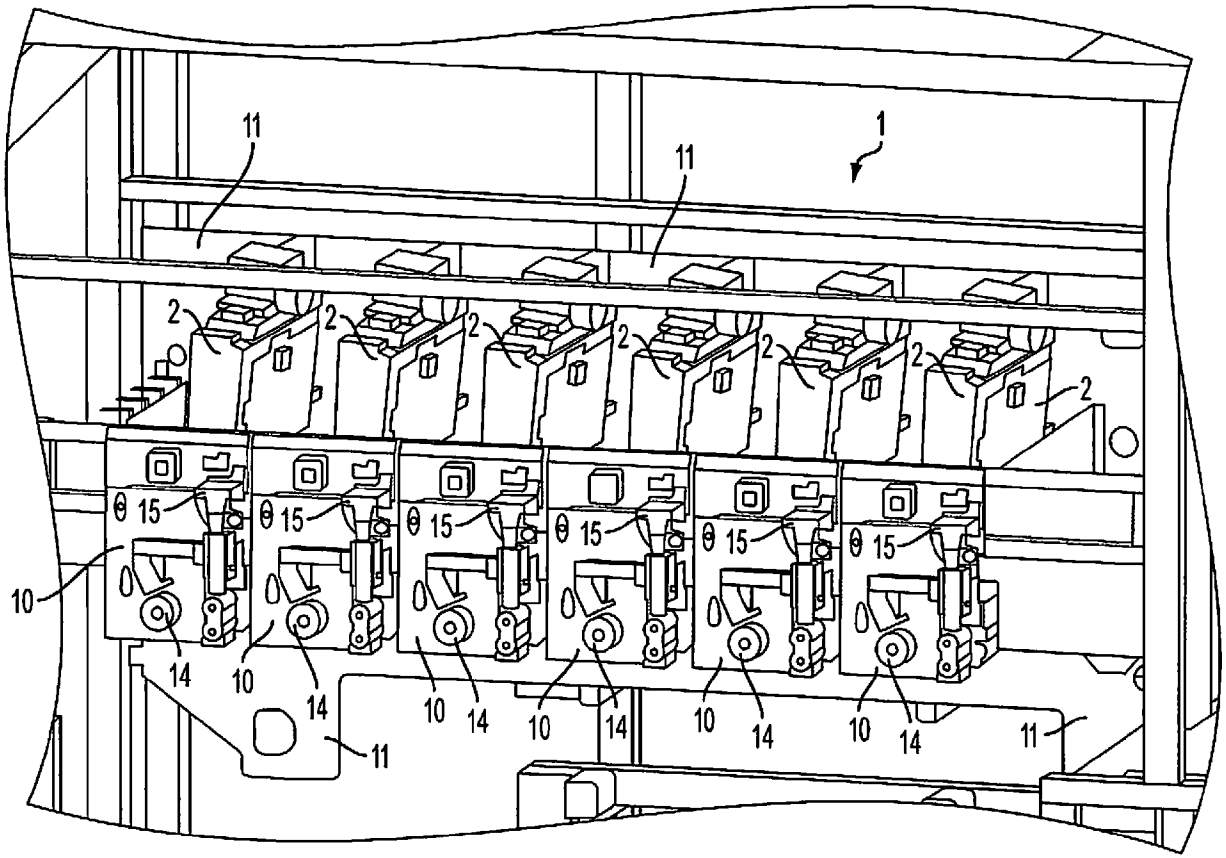
FIG. 2 is perspective view of the system of FIG. 1 while showing the imaging stations that contain the drums shown in FIG. 1.

In FIG. 2 the imaging station 10 that internally include the photoconductive drums 5 of FIG. 1 are shown. For clarity, the endless belt 3 of FIG. 1 and drums 5 are not shown in FIG. 2. The fixed ROS structures 2 are shown above the imaging stations 10; in this embodiment the ROS structures 2 are rigidly mounted to the machine frame 11 such that it is not sensitive to machine vibrations. The xerographic station of imaging station 10 is skewed relative to the ROS 2 via a linear actuator 8 and slide 13 shown in FIGS. 3 and 4. An exterior portion of drum connector 14 is shown where the drum is connected in the interior portion of imaging stations 10. A toner feed conduit 15 is shown for each imaging station 10. The imaging stations 10 are movable and skewable while the ROS 2 are fixed in place.

Figure 3:
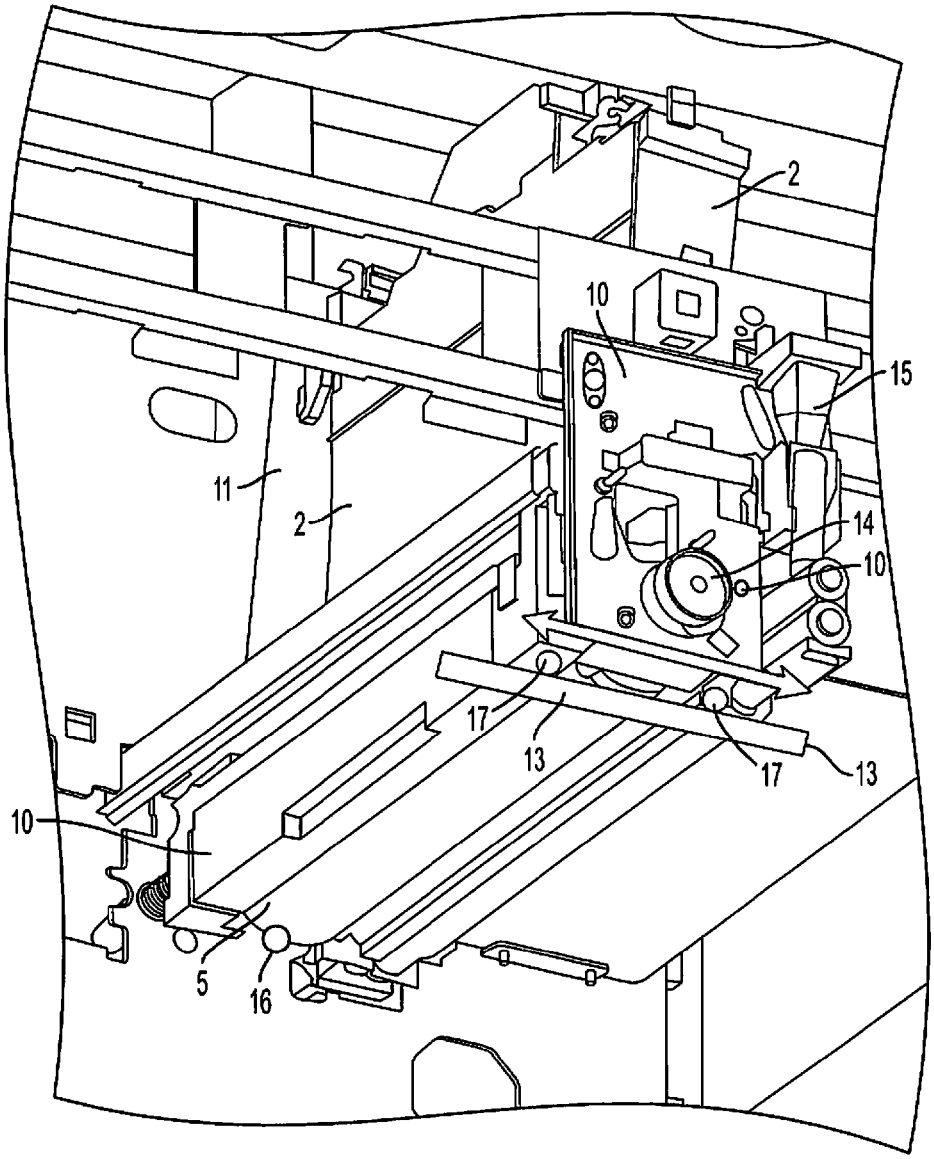
FIG. 3 is a perspective bottom view of the imaging station with the slide/actuation mechanism-deskew structure of the present invention.

In FIG. 3 a bottom perspective view of the skewable imaging station 10 is shown as it is positioned below fixed ROS structures 2. The ROS structure 2 is rigidly fixed to machine frame 11; while inboard sphere 16 (pivot sphere) and outboard spheres 17 located in grooves 18 below the imaging station 10 permit easy skewing of imaging station 10 when needed. Outboard spheres 17 travel along a slide or track 13 during the deskewing operation, while the entire imaging station 10 will pivot along sphere 16. In the deskewing operation of xerographic station 10, sensors 9 view the beams 4, then transfers this information (if needed) to deskew beam 4 to a controller or to motor 22. Motor 22 then automatically skews the imaging or xerographic station 10 to the distance needed for proper beam alignment. In multiple ROS stations (two or more) each emitted beam 4 is monitored by a sensor to ensure proper alignment with the other ROS stations. If not in proper alignment, the sensor (as above noted) will instruct the motor 22 or linear actuator 8 how to move or deskew the imaging station 10 along spheres 16 and 17 to be in proper alignment with beam 4.

In FIG. 4, a front plan view of imaging station 10 is shown. The inboard mounting sphere 16 sits in a coned socket 18 to locate the inboard side of the xerographic station or imaging station 10 and the outboard spheres 17 mount in a slide mechanism 13 that is actuated left and right by motor 22 to change the relative skew of the drum 5 with respect to the ROS. This 3-point mount allows the orientation of the xerographic station 10 relative to the rest of the machine to be maintained. A flexible dispense tube 15 would have to be employed to transport toner from the toner bottle to the developer station since the xerographic station 10 can now translate left to right on the outboard side (pivoting the xerographic station on the outboard side would also be possible and reduce the amount of flexibility required by the dispense tube). Additionally, the linear slide 13 is of a configuration that would allow the xerographic station to lift up and slide out of the front of the machine (thus the sphere 17 and v-groove slot 19 shown in FIG. 4). The motor 22 that drives the PR drum 5 currently is fixed to the back plate of the machine and remains in the machine when the xerographic station 10 is removed. To enable this same feature in the presence of a skewable xerographic station 10, the drum drives 14 would be mounted to the machine frame via a flexible coupling that would loosely keep the drive shaft in placed when the xerographic station 10 is removed, but allow it to lock in place as the xerographic station 10 is re-installed and rotate with the station as deskew is performed.

Figure 5:
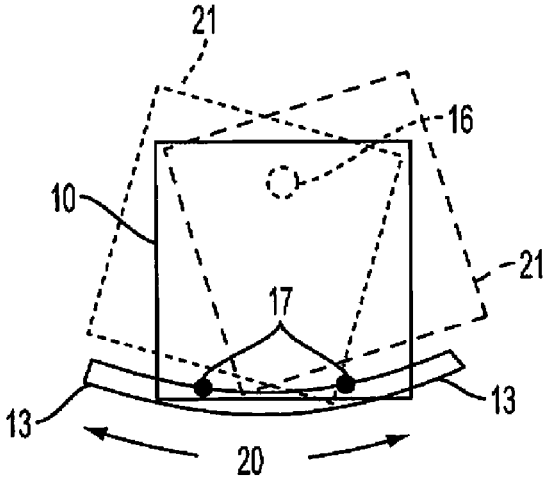
FIG. 5 is a schematic top view of an embodiment of the skewable imaging station of this invention.

In FIG. 5 a schematic top view of the movement or deskewing of imaging station 10 is shown. The imaging station 10 pivots along inboard sphere 16 and moves on outboard spheres 17 along tracks 13 as shown by arrows 20. The dotted lines 21 show the movement of the imaging station 10 when pivoted on sphere 16 and moved along track 13.

Figure 6:
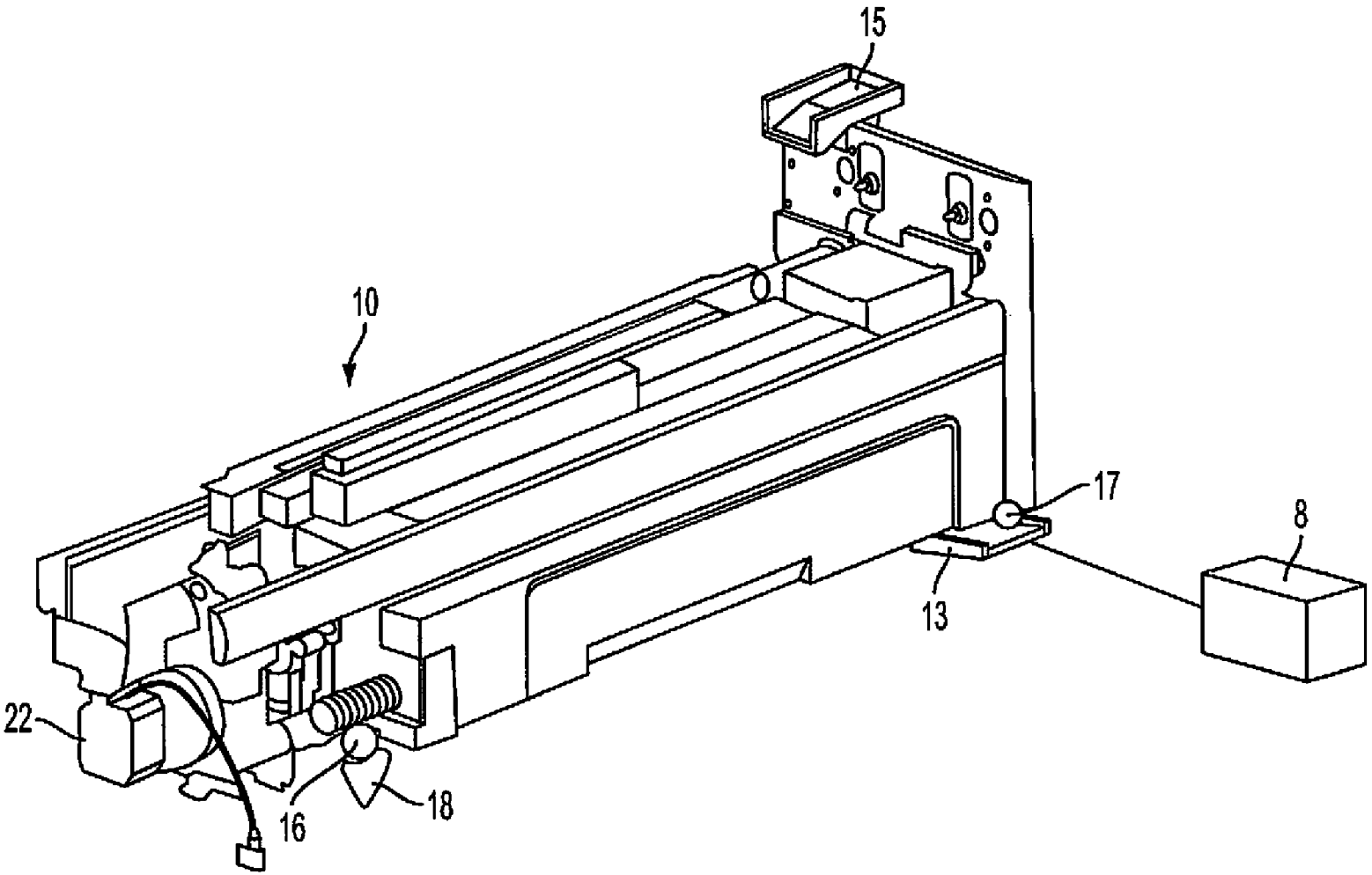
FIG. 6 is a side perspective view of an embodiment of the imaging station showing the locations of the inboard and outboard spheres used in the movement of the imaging station.

In FIG. 6 a side view of the imaging station 10 is shown where an inboard mounting sphere (pivot) 16 sits in a cone socket 18 and outboard mounting spheres (17) (1 of 2 shown) located in track 13. The v-grooves 19 housing spheres 17 is not shown in this figure for clarity, but these grooves 19 are shown in FIG. 4. FIG. 6 clearly shows the positions of outboard spheres 17 and inboard pivot sphere 18.

In summary, the present invention provides a raster output scanner (ROS) Imaging Station unit useful in a xerographic marking apparatus. This apparatus comprises an image beam emitting ROS structure, and located below said ROS structure is a xerographic imaging station. The ROS structure is rigidly and immovably fixed to the marking apparatus, and the xerographic imaging station is movably positioned and configured to be laterally moved upon a skewing operation. The imaging station has a pivotable sphere at a bottom portion thereof on its inboard side and has at least two spheres located on a track at an outboard position permitting lateral movement of said imaging station on said track or slide. The inboard and said outboard spheres are configured to allow an orientation of said xerographic station relative to said ROS structure. The imaging station is connected to and moved by a linear actuator or motor. The track or slide is configured to allow the imaging station to move laterally thereon and pivot on said inboard sphere. The slide is configured to allow said imaging station to lift up and slide out of a front of said xerographic marking apparatus.

There is a sensor in the apparatus configured to monitor a beam emitted from said ROS, the sensor is configured to transmit information on said beam to a motor that accordingly moves said imaging station along said tracks. The imaging station is configured to be deskewed relative to the fixed ROS via a linear actuator and the slide. This unit has two spherical points that mount the imaging station to the slide on said outboard side and one spherical point on said inboard side that acts as a pivot for the imaging station. The pivotable sphere sits in a cone socket on the inboard side of said imaging station. The outboard spheres mount in V-groove slots in said slide or track mechanism.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A raster output scanner (ROS) imaging station unit used in a xerographic marking apparatus comprising;

an image beam emitting ROS structure and located below said ROS structure is a xerographic imaging station, one or more sensors configured to monitor a beam emitted from said ROS, said ROS structure rigidly and immovably fixed to said marking apparatus, said xerographic imaging station movably positioned and configured to be laterally moved upon a deskewing operation, said imaging station having a pivotable sphere located in a coned socket at a bottom portion thereof on its inboard side and having at least two spheres located on a track at an outboard position permitting lateral movement of said imaging station on said track, said track being configured to allow said imaging station to move laterally thereon using the outboard spheres and pivot on said inboard sphere, wherein said track having two v-groove slots and the two outboard spheres each rest in one of the two v-groove slots to allow the imaging station to lift up and slide out of the xerographic marking apparatus, wherein said imaging station is connected to and moved by a linear actuator or motor along said track, said one or more sensors transmitting information on said beam to the linear actuator or motor that moves said imaging station along said tracks, said inboard and said outboard spheres configured to allow an orientation of said xerographic station relative to said ROS structure, and wherein said imaging station includes a flexible dispense tube that allows toner to be transported from a toner bottle to a developer station.

* * * * *